US012053066B2

(12) United States Patent
Takuma

(10) Patent No.: US 12,053,066 B2
(45) Date of Patent: Aug. 6, 2024

(54) CLAMPING STRUCTURE FOR PERSONAL ORNAMENT

(71) Applicant: KABUSHIKIGAISHA PIERRING, Yamanashi (JP)

(72) Inventor: Kenji Takuma, Yamanashi (JP)

(73) Assignee: KABUSHIKIGAISHA PIERRING, Yamanashi (JP)

( * ) Notice: Subject to any disclaimer, the term of this patent is extended or adjusted under 35 U.S.C. 154(b) by 196 days.

(21) Appl. No.: 17/601,171

(22) PCT Filed: Sep. 9, 2019

(86) PCT No.: PCT/JP2019/035298
§ 371 (c)(1),
(2) Date: Oct. 4, 2021

(87) PCT Pub. No.: WO2020/202599
PCT Pub. Date: Oct. 8, 2020

(65) Prior Publication Data

US 2022/0167716 A1 Jun. 2, 2022

(30) Foreign Application Priority Data

Apr. 4, 2019 (JP) ..... 2019-071975

(51) Int. Cl.
*A44C 7/00* (2006.01)

(52) U.S. Cl.
CPC ..... *A44C 7/006* (2013.01)

(58) Field of Classification Search
CPC ..... A44C 7/006; A44C 5/00; A44C 7/004; A44C 7/007; A44C 9/0046; Y10T 403/32614; E05D 2003/025
(Continued)

(56) References Cited

U.S. PATENT DOCUMENTS 2,351,925 A * 6/1944 Chernow ..... A44C 7/006 63/14.4
3,500,511 A * 3/1970 Gloss ..... A44C 7/006 63/14.3

(Continued)

FOREIGN PATENT DOCUMENTS

JP 62-110920 7/1987
JP 10-276810 10/1998

(Continued)

OTHER PUBLICATIONS

International Search Report issued Oct. 8, 2019 in International (PCT) Application No. PCT/JP2019/035298.

*Primary Examiner* — Jack W Lavinder
(74) *Attorney, Agent, or Firm* — Wenderoth, Lind & Ponack, L.L.P.

(57) ABSTRACT

An earring including a primary ornamental body and a clamping member, a pair of mounting legs and a mounting base held in between formed at an end of the ornamental body and an end of the clamping member, respectively, the pair of mounting legs and the mounting base being pivotably attached to each other with one or two or more elastic metal plate members interposed therebetween, the pivot portion being swaged together with the metal plate member. The mounting base has a recessed groove or notch formed in its outer periphery, and when the mounting legs and the mounting base are relatively turned, the metal plate member is deflected into the recessed groove or notch of the mounting base, and the deflected portion is engaged with an end edge of the recessed groove or notch of the mounting base.

3 Claims, 5 Drawing Sheets

(58) Field of Classification Search
USPC ..... 16/277, 271, 234
See application file for complete search history.

(56) References Cited

U.S. PATENT DOCUMENTS

| | | | | | |
|---|---|---|---|---|---|
| 5,816,073 | A * | 10/1998 | Bardisbanyan | A44C 7/004 | 24/616 |
| 5,829,273 | A * | 11/1998 | Weingast | A44C 7/004 | 24/616 |
| 2011/0265287 | A1* | 11/2011 | Li | E05D 11/0054 | 16/297 |
| 2013/0104341 | A1* | 5/2013 | Kenerly | E05D 5/16 | 16/273 |

FOREIGN PATENT DOCUMENTS

| | | |
|---|---|---|
| JP | 2000-60612 | 2/2000 |
| JP | 3130993 | 4/2007 |
| JP | 3139659 | 2/2008 |
| JP | 4592116 | 12/2010 |

* cited by examiner

[FIG. 1]
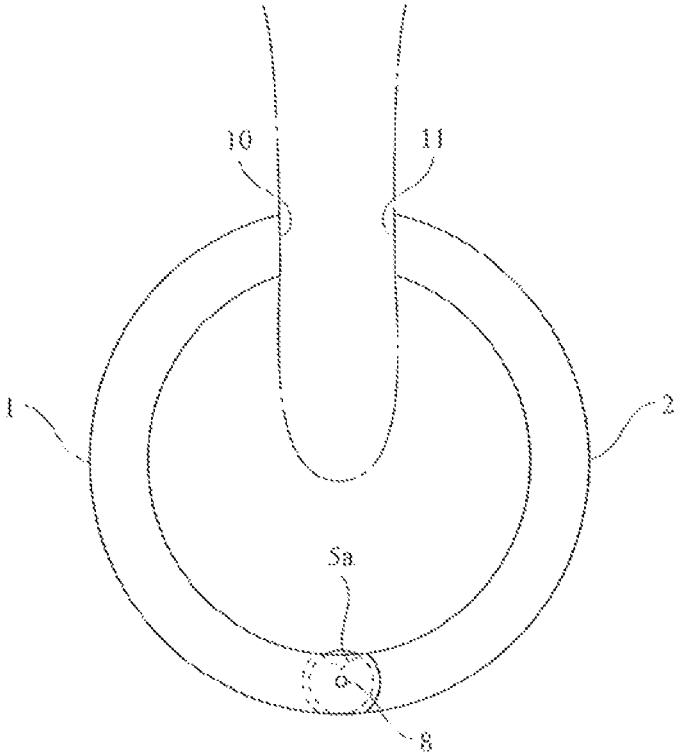

[FIG. 2(a)]
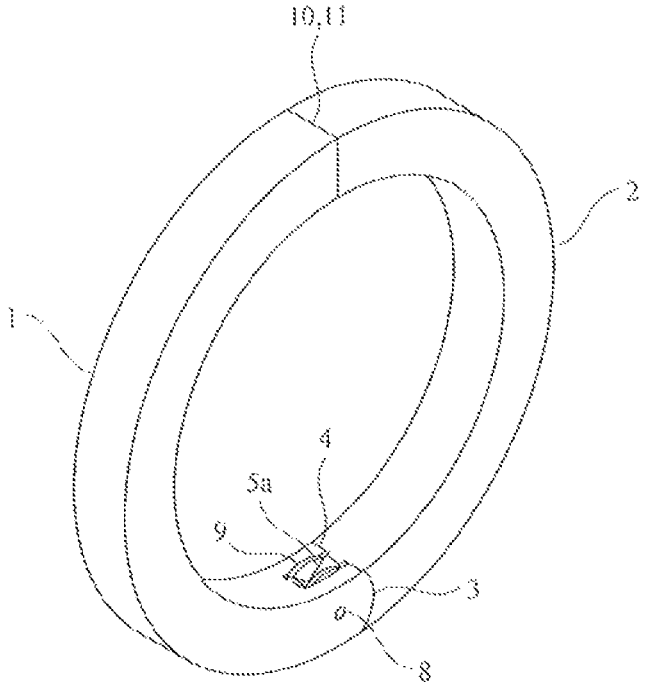
[FIG. 2(b)]
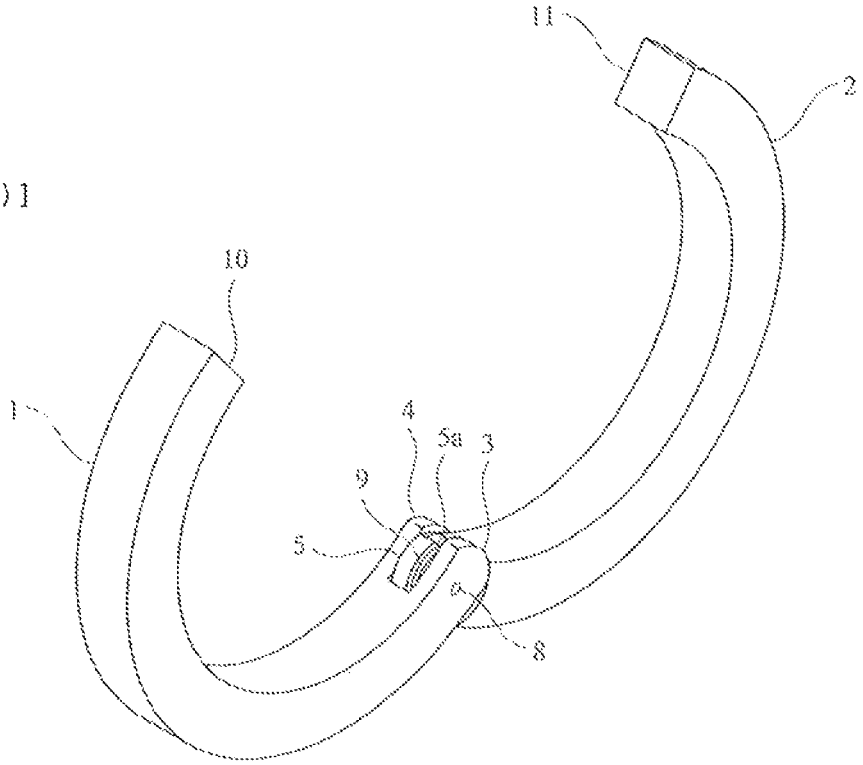

[FIG. 3(a)]
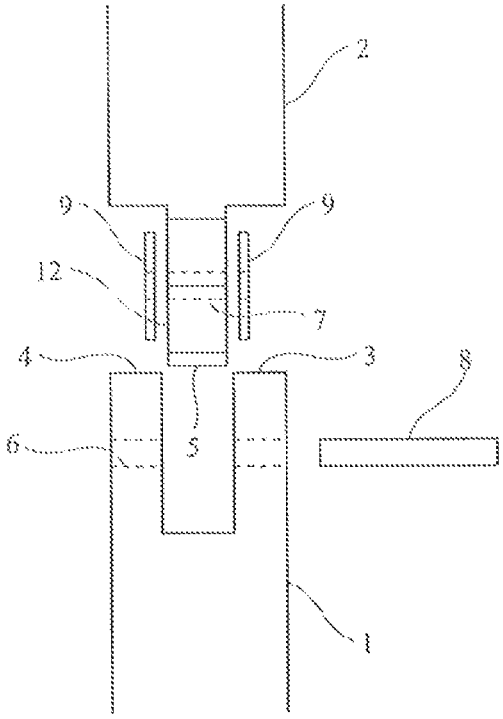
[FIG. 3(b)]
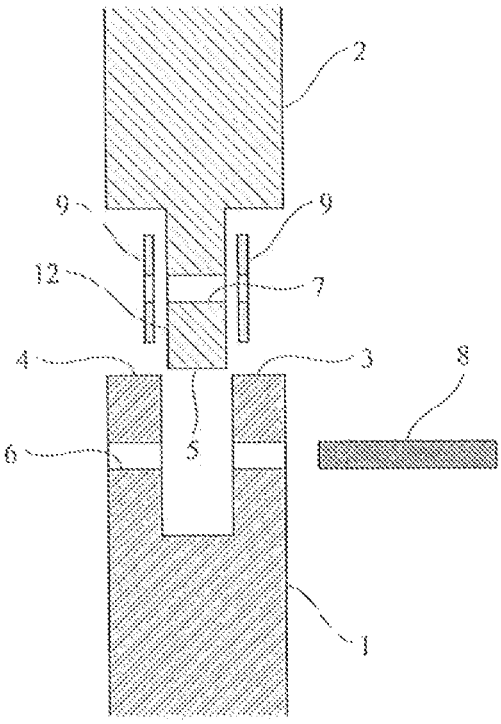
[FIG. 4]
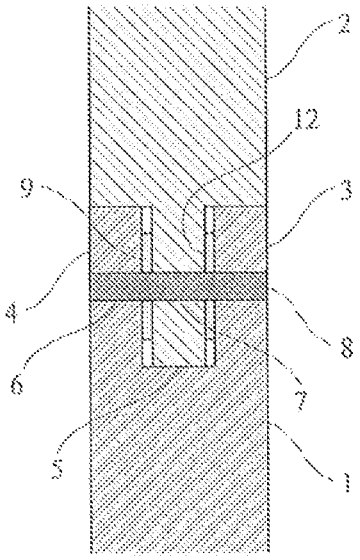

[FIG. 5]
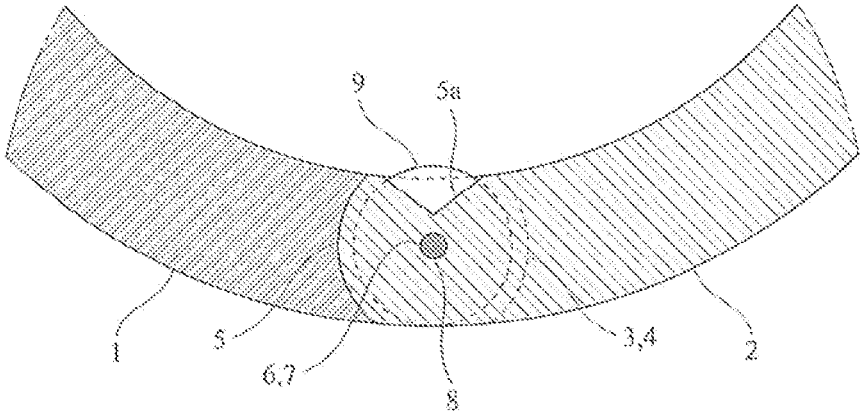
[FIG. 6]
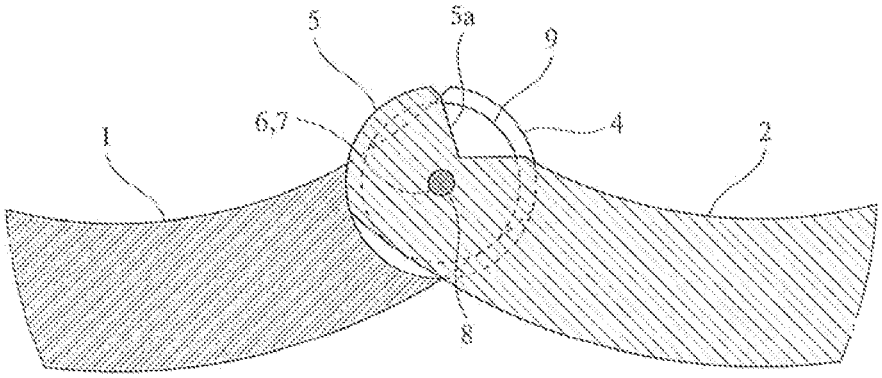
[FIG. 7]
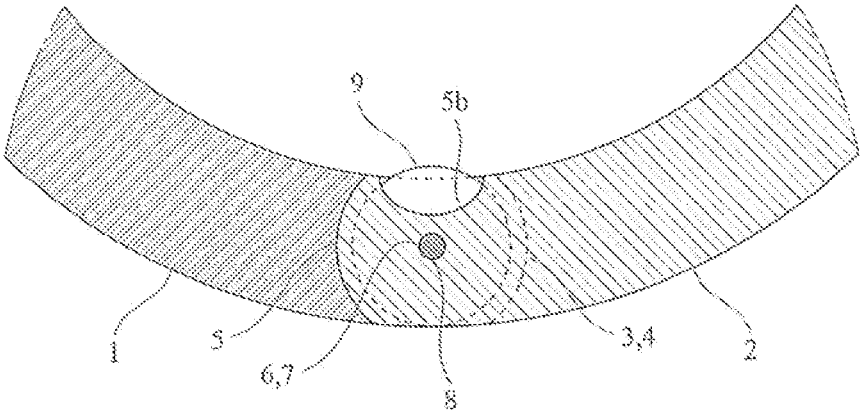

[FIG. 8]
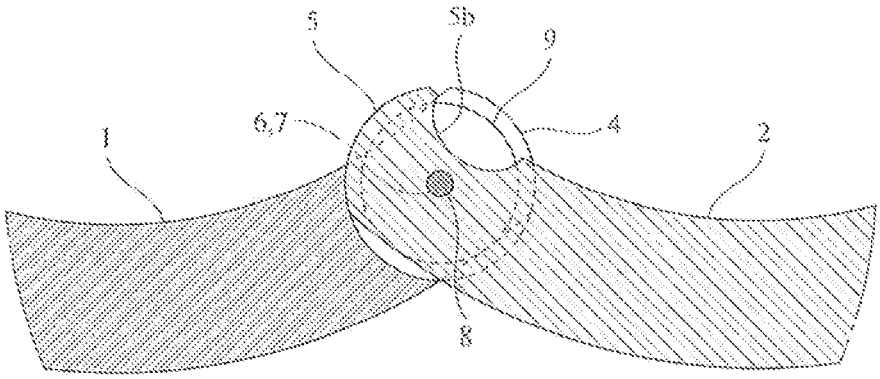
[FIG. 9]
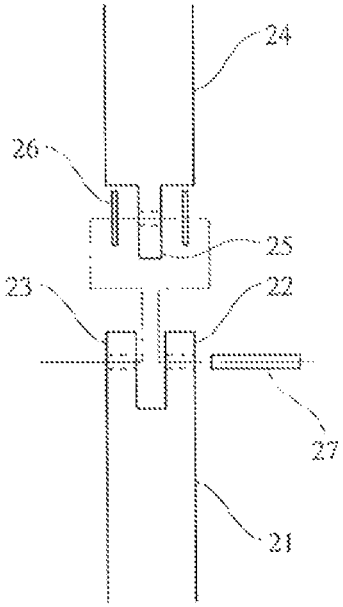
[FIG. 10]
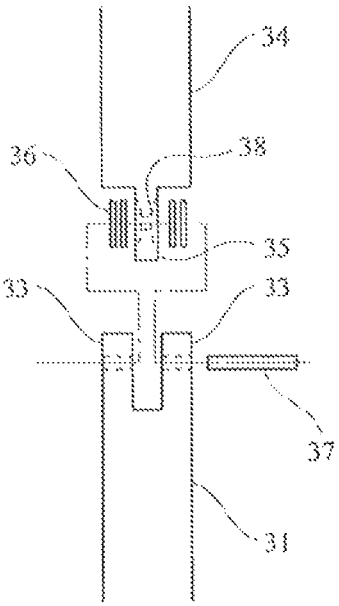

CLAMPING STRUCTURE FOR PERSONAL ORNAMENT

TECHNICAL FIELD

This invention relates to a clamping structure for a personal ornament.

BACKGROUND ART

The present inventor has proposed novel clip-on earrings since before.

First of all, in Japanese Patent Application Laid-Open Publication No. H10-276810 (See PTL 1), as shown in FIG. 9, the present inventor proposed a clip-on earring provided with a primary ornamental body 21 provided with a pair of mounting legs 22, 23, and a clamping member 24 formed with a mounting base 25 accommodated in between the pair of mounting legs 22, 23, wherein a washer 26 is interposed between the mounting legs 22, 23 and the mounting base 25, a pin 27 is passed therethrough, and these portions are swaged, thereby imparting a clamping force when they are closed.

The above clip-on earring having the washer-like plate member interposed therein can be attached to the earlobe by their friction without exerting so great a clamping force, and the mounting legs and the mounting base brought into contact with each other by opening and closing them repeatedly can be prevented to a certain extent from being abraded or deformed by contact friction, but a problem remains where the clamping force is likely to decrease during use.

Then, in Japanese Utility Model Registration No. 3130993 (PTL 2), the present inventor proposed a clip-on earring having a primary ornamental body 31 as a first member formed with a pair of mounting legs 32, 33 and a clamping member 34 as a second member formed with a mounting base 35, the pair of mounting legs 32, 33 and the mounting base 35 being pivotably attached to each other by a pin 37 with at least two or more flat and smooth metal plate members 36 interposed therebetween, and the pivot portion being swaged together with the metal plate members 36, wherein a recessed portion 38 having a larger area than the metal plate member 36 is formed in a plate face of the mounting base 35.

In addition, the present inventor found that the flat and smooth metal plate member 36 interposed between the pair of mounting legs 32, 33 and the mounting base 35 might be one in number, and also proposed Japanese Utility Model Registration No. 3139659 (PTL 3).

In these Japanese Utility Model Registration No. 3130993 (PTL 2) and Japanese Utility Model Registration No. 3139659 (PTL 3), the earrings have the pair of mounting legs and the mounting base pivotably attached to each other with one or two or more flat and smooth metal plate members interposed therebetween, the pivot portion being swaged together with the metal plate member, wherein a recessed portion having a larger area than the metal plate member is formed in a plate face of the mounting base.

However, though having the advantage that the clamping force is retained over a remarkably long period of time by providing that the flat and smooth metal plate member is one or more in number, these earrings have a problem where they are complicated to manufacture, which causes an increase in cost.

Therefore, in Japanese Patent No. 4592116 (PTL 4), the present inventor proposed a clip-on earring having a primary ornamental body as a first member formed with a pair of mounting legs and a clamping member as a second member formed with a mounting base, the pair of mounting legs and the mounting base being pivotably attached to each other with one or two elastic flat and smooth metal plate members interposed therebetween, the pivot portion being swaged together with the metal plate members, wherein the mounting base is so formed as to have a width narrower than the diameter of the metal plate member, and when the mounting legs and the mounting base formed on the primary ornamental body as the first member and the clamping member as the second member, respectively, are relatively turned, the metal plate member is deflected inward at a portion intersecting with a widthwise end edge of the mounting base by a load applied at a portion abutting against the mounting base, and the deflected portion is engaged with the end edge of the mounting base.

CITATION LIST

Patent Literature

PTL 1: Japanese Patent Application Laid-Open Publication No. H10-276810
PTL 2: Japanese Utility Model Registration No. 3130993
PTL 3: Japanese Utility Model Registration No. 3139659
PTL 4: Japanese Patent No. 4592116

SUMMARY OF INVENTION

Technical Problem

In the above invention of Japanese Patent No. 4592116 (PTL 4), however, since the mounting base is so formed as to have a width narrower than the diameter of the metal plate member, the metal plate member sticks out of the mounting base, and may impair the aesthetic appearance or may hurt a finger in handling.

While continuing diligent studies for this reason, the present inventor found a chipped mounting base (male). The present inventor tried assembling the metal plate member to this chipped mounting base to examine its effect.

As a result, it was discovered that the effect of retaining the clamping force equivalent to or more than the above invention of Japanese Patent No. 4592116 (PTL 4) over a remarkably long period of time was achieved.

Therefore, a clamping structure for a personal ornament of this invention is intended to provide a clamping structure in which the mounting base has a recessed groove or notch formed in its outer periphery, and when the mounting legs and the mounting base formed on the primary ornamental body as the first member and the clamping member as the second member, respectively, are relatively turned, the metal plate member is deflected inward into the recessed groove or notch of the mounting base, and the deflected portion is engaged with an end edge of the recessed groove or notch of the mounting base, so that the load applied to the metal plate member is applied at a portion intersecting with the end edge of the recessed groove or notch of the mounting base, thereby achieving a great clamping force, and making it capable of withstanding use for a long period of time.

Solution to Problem

That is, the clamping structure for a personal ornament of this invention is an earring including a primary ornamental body as a first member and a clamping member as a second member, a pair of mounting legs and a mounting base held in therebetween being formed at an end of the primary ornamental body and an end of the clamping member, respectively, the pair of mounting legs and the mounting base being pivotably attached to each other with one or two or more elastic metal plate members interposed therebetween, the pivot portion being swaged together with the metal plate member, the earring being characterized in that the mounting base has a recessed groove or notch in its outer periphery, and when the mounting legs and the mounting base formed on the primary ornamental body as the first member and the clamping member as the second member, respectively, are relatively turned, the metal plate member is deflected inward into the recessed groove or notch of the mounting base, and the deflected portion is engaged with an end edge of the recessed groove or notch of the mounting base.

The clamping structure for a personal ornament of this invention is also characterized in that the metal plate member has a thickness in a range from 0.1 to 0.3 mm.

The clamping structure for a personal ornament of this invention is also characterized in that the recessed groove or notch formed in the outer periphery of the mounting base is so formed as to be U-shaped or V-shaped in cross section.

Advantageous Effects of Invention

As described above, in this invention, the mounting base has a recessed groove or notch in its outer periphery, and when the mounting legs and the mounting base formed on the primary ornamental body as the first member and the clamping member as the second member, respectively, are relatively turned, the metal plate member is deflected inward into the recessed groove or notch of the mounting base, and the deflected portion is engaged with an end edge of the recessed groove or notch of the mounting base.

This, surprisingly, enables achievement of the remarkable effect of improving the clamping force more than the invention of the cited literature 4 and, moreover, retaining the clamping force over a remarkably long period of time, and successfully fundamentally solves the problem of retainment of the clamping force that is a weakness of this kind of products.

When an experiment was tried using a sample in which a notch having a U-shaped cross section was formed in the outer periphery of the mounting base to a depth of one-third the diameter thereof, and in which three 0.15-mm-thick metal plate members were disposed on each side of the mounting base, the sample had a retaining force enough to withstand use even after the opening and closing operation was performed five thousand times.

In addition, in the prior art of the cited literature 4, in order to stick the metal plate member out of the width of the mounting base, the position of a pivot pin is offset from a central position of the mounting base, and this mounting task is very troublesome, but this problem is also solved in the present invention.

It is presumed that, regarding the function of the clamping structure for a personal ornament of this invention of increasing the clamping force onto the earlobe tremendously as compared with a conventional one, and moreover retaining the clamping force at a constant level for a long period of time, the elasticity of the metal plate member due to deflection of the metal plate member caused by the load applied to the metal plate member acting on a portion intersecting with the end edge of the recessed groove or notch of the mounting base acts directly, so that such a remarkable effect can be achieved.

It is also presumed that a friction caused by the plate face of the metal plate member being brought into contact and engaged with the portion intersecting with the end edge of the recessed groove or notch of the mounting base influences the improvement of the clamping force, and the like.

Incidentally, a conventional earring having a washer interposed simply therebetween showed a reduction in the clamping force after the opening and closing operation was repeated several tens to hundreds of times, whereas the earring of this invention showed no reduction in the clamping force at all even after several hundred or more opening and closing operations, and the clamping force itself was much better than the conventional washer type earring.

BRIEF DESCRIPTION OF DRAWINGS

FIG. 1 is a side view showing an example of a clamping structure for a personal ornament of this invention.

FIG. 2(*a*) is a perspective view with clamping members on both sides closed, and FIG. 2(*b*) is a perspective view having the clamping members on both sides opened.

FIG. 3(*a*) is a transparent view of pivotably-attached portions in their disassembled state, and FIG. 3(*b*) is a cross-sectional view of the pivotably-attached portions in their disassembled state.

FIG. 4 is a cross-sectional view thereof in their assembled state.

FIG. 5 is an enlarged view of the pivotably-attached portions if a notch having a V-shaped cross section is applied.

FIG. 6 is an enlarged view thereof in their opened state.

FIG. 7 is an enlarged view of the pivotably-attached portions if a notch having a U-shaped cross section is applied.

FIG. 8 is an enlarged view thereof in their opened state.

FIG. 9 is a schematic view showing a conventional example of a clamping structure for a personal ornament.

FIG. 10 is a schematic view showing another conventional example of a clamping structure for a personal ornament.

DESCRIPTION OF EMBODIMENTS

Embodiments of a clamping structure for a personal ornament of this invention will be described in more detail below with reference to the drawings.

In an example shown in FIGS. 1 to 6 where the clamping structure for a personal ornament of the present invention is applied to a clip-on earring, 1 denotes a primary ornamental body, 2 denotes a secondary ornamental body as an earlobe clamping portion, their overall shapes are substantially the same arc-like shapes, and they form a ring-like shape in their assembled state. It should be noted that though a gemstone composed of a diamond or the like is not attached to a front face side in this embodiment, a gemstone may be freely attached and, of course, the earring may be attached whichever of them faces the front side of the earlobe. In addition, their cross-sectional shapes are also substantially arc-like shapes, so-called a round shape, but the shapes are not limited to the round shape. It should be noted that regarding their materials, gold (18K or the like), platinum, silver, or the like, may be used for both of them.

A connecting portion of the primary ornamental body 1 is integrally provided with a pair of mounting legs 3, 4, opposite to which a connecting portion of the secondary ornamental body 2 is formed integrally with a mounting base 5 fitted in between the mounting legs 3, 4.

Furthermore, a pivot pin 8 is passed through through-holes 6, 7 opened in them, this portion is swaged, and the swaging at this time is performed with elastic one or two flat and smooth metal plate members 9 having a thickness of 0.1 to 0.3 mm, preferably made of stainless steel or the like having a thickness of 0.15 mm, interposed between the mounting legs 3, 4 and the mounting base 5.

The reason why the thickness of the flat and smooth metal plate member 9 is in a range from 0.1 to 0.3 mm is that, if it is less than 1 mm, the elasticity cannot be made use of. Similarly, if it is more than 0.3, the metal plate member itself loses elasticity.

Though the metal plate member 9 may be one or two in number, it is desired that the metal plate member 9 be two in number, taking into consideration the retainability of the clamping force, because even two metal plate members cause no problem in terms of economy and assembly workability and the like.

It should be noted that the reference signs 10, 11 denote earpad portions formed on an end face of the primary ornamental body 1 and an end face of the secondary ornamental body 2, and they may employ an anti-slip structure having a wavy cross section.

In this example, the mounting base 5 has a recessed groove or notch 5*a* having a V-shaped cross section formed in its outer periphery, as shown in FIGS. 3(*a*), 3(*b*) or FIG. 6, and, when the mounting legs 3, 4 and the mounting base 5 formed on the primary ornamental body 1 as a first member and the clamping member 2 as a second member, respectively, are relatively turned, the metal plate member 9 is deflected inward into the recessed groove or notch 5*a* of the mounting base 5, and the deflected portion is engaged with an end edge of the recessed groove or notch 5*a* of the mounting base 5. That is, when the mounting legs 3, 4 and the mounting base 5 formed on the primary ornamental body 1 as the first member and the clamping member 2 as the second member, respectively, are relatively turned, a load applied to the metal plate member 9 is applied at a portion of the mounting base 5 intersecting with the end edge of the recessed groove or notch 5*a*.

FIGS. 7 and 8 illustrate another example of the present invention, and a recessed groove or notch 5*b* having a U-shaped cross section is formed in the outer periphery of the mounting base 5. It should be noted that the recessed groove or notch 5*b* having a U-shaped cross section also achieved a similar action and effect to the recessed groove or notch 5*a* having a V-shaped cross section.

It is presumed that, regarding the function of the clip-on earring of this example of increasing the clamping force onto the earlobe tremendously as compared with a conventional one, and moreover retaining the clamping force at a constant level for a long period of time, the elasticity of the metal plate member 9 due to deflection and engagement of the one or two metal plate members 9 at a portion of the metal plate member 9 intersecting with an end edge substantially radially extending from the pivot pin 8 of the recessed groove or notch 5*a* of the mounting base 5 when a pivot portion is fastened acts effectively, so that such a remarkable effect can be achieved.

It is also presumed that a friction between the end edge of the recessed groove or notch 5*a* of the mounting base 5 and the plate face of the metal plate member 9 influences the improvement of the clamping force, and the like.

Incidentally, a conventional earring having a washer simply interposed therebetween showed a reduction in the clamping force after the opening and closing operation was repeated several tens to hundreds of times, whereas the earring of this example showed almost no reduction in the clamping force even after several thousand or more opening and closing operations, and the clamping force itself was much better than that of the conventional washer type earring.

INDUSTRIAL APPLICABILITY

As described above, this invention has the recessed groove or notch formed in the outer periphery of the mounting base, and when the mounting legs and the mounting base formed on the primary ornamental body as the first member and the clamping member as the second member, respectively, are relatively turned, a load applied to the metal plate member is applied at a portion intersecting with the end edge of the recessed groove or notch of the mounting base.

Therefore, it goes without saying that the present invention is applicable not only to an earring using an arc-like clamping member, such as shown in the drawings, but also to an earring having another design, and an earring provided with a pin for piercing.

It also goes without saying that the present invention is applicable not only to an earring, but also to a variety of personal ornaments requiring the opening and closing operation, such as a finger ring or a bracelet, unless the spirit of the present invention is changed.

REFERENCE SIGNS LIST

1 primary ornamental body
2 secondary ornamental body
3, 4 mounting leg
5 mounting base
5*a* recessed groove or notch
6, 7 through-hole
8 pivot pin
9 metal plate member
10, 11 earpad portion
21 primary ornamental body
22, 23 mounting leg
24 clamping member
25 mounting base
26 washer
27 pin
31 primary ornamental body
32, 33 mounting leg
34 clamping member
35 mounting base
36 metal plate member
37 pin
38 recessed portion

The invention claimed is:

1. An earring comprising:

a primary ornamental body;

a clamping member;

a pair of mounting legs formed at an end of the primary ornamental body; and a mounting base formed at an end of the clamping member and held between the pair of mounting legs;

wherein the pair of mounting legs and the mounting base are pivotably attached to each other with at least one elastic metal plate member interposed therebetween, and wherein the mounting base has a recessed groove or notch formed in an outer periphery of the mounting base, such that when the mounting legs and the mounting base are relatively turned, the metal plate member is deflected inward into the recessed groove or notch of the mounting base, and the metal plate so deflected is engaged with an end edge of the recessed groove or notch of the mounting base.

2. The earring according to claim 1, wherein the metal plate member has a thickness in a range from 0.1 to 0.3 mm.

3. The earring according to claim 1, wherein the recessed groove or notch formed in the outer periphery of the mounting base is so formed as to be U-shaped or V-shaped in cross section.

* * * * *